US010516941B2

(12) United States Patent
Chen et al.

(10) Patent No.: US 10,516,941 B2
(45) Date of Patent: Dec. 24, 2019

(54) REDUCING INSTANTANEOUS WIND NOISE

(71) Applicant: Cirrus Logic International Semiconductor Ltd., Edinburgh (GB)

(72) Inventors: Henry Chen, Cremorne (AU); Thomas Ivan Harvey, Cremorne (AU)

(73) Assignee: Cirrus Logic, Inc., Austin, TX (US)

( * ) Notice: Subject to any disclaimer, the term of this patent is extended or adjusted under 35 U.S.C. 154(b) by 109 days.

(21) Appl. No.: 15/312,987

(22) PCT Filed: Jun. 1, 2015

(86) PCT No.: PCT/AU2015/050298
§ 371 (c)(1),
(2) Date: Nov. 21, 2016

(87) PCT Pub. No.: WO2015/184499
PCT Pub. Date: Dec. 10, 2015

(65) Prior Publication Data
US 2018/0234760 A1 Aug. 16, 2018

(30) Foreign Application Priority Data
Jun. 4, 2014 (AU) ..... 2014902130

(51) Int. Cl.
*H04R 3/00* (2006.01)
*G10L 21/0208* (2013.01)
*H04R 1/08* (2006.01)

(52) U.S. Cl.
CPC ..... *H04R 3/005* (2013.01); *G10L 21/0208* (2013.01); *H04R 1/086* (2013.01);
(Continued)

(58) Field of Classification Search
None
See application file for complete search history.

(56) References Cited

U.S. PATENT DOCUMENTS

2004/0165736 A1* 8/2004 Hetherington ..... G10L 21/0208 381/94.3
2006/0120540 A1* 6/2006 Luo ..... H04R 25/407 381/98
(Continued)

FOREIGN PATENT DOCUMENTS

WO 2013091021 A1 6/2013
WO 2013187946 A2 12/2013
(Continued)

OTHER PUBLICATIONS

Extended European Search Report, Application No. EP15824154.7, dated Dec. 12, 2017.
(Continued)

*Primary Examiner* — James K Mooney
(74) *Attorney, Agent, or Firm* — Jackson Walker L.L.P.

(57) ABSTRACT

Wind noise reduction is provided by obtaining a first signal from a first microphone and a contemporaneous second signal from a second microphone. A level of the first signal is compared to a level of the second signal, within a short or substantially instantaneous time frame. If the level of the first signal exceeds the level of the second signal by greater than a predefined difference threshold, a suppression is applied to the first signal.

20 Claims, 6 Drawing Sheets

(52) U.S. Cl.
CPC ..... *H04R 2410/07* (2013.01); *H04R 2430/03* (2013.01); *H04R 2499/11* (2013.01)

(56) References Cited

U.S. PATENT DOCUMENTS

| | | | | |
|---|---|---|---|---|
| 2007/0058822 | A1 | 3/2007 | Ozawa | |
| 2007/0078649 | A1* | 4/2007 | Hetherington ..... | G10L 21/0216 704/226 |
| 2008/0226098 | A1* | 9/2008 | Haulick ..... | G10L 21/0208 381/94.9 |
| 2009/0238369 | A1 | 9/2009 | Ramakrishnan et al. | |
| 2012/0148067 | A1 | 6/2012 | Petersen et al. | |
| 2014/0079245 | A1* | 3/2014 | Maruko ..... | H04R 3/002 381/94.7 |

FOREIGN PATENT DOCUMENTS

| | | | |
|---|---|---|---|
| WO | 2014062152 | A1 | 4/2014 |
| WO | 2014104815 | A1 | 7/2014 |

OTHER PUBLICATIONS

International Search Report and Written Opinion of the International Searching Authority, International Application No. PCT/AU2015/050298, dated Aug. 18, 2015.

* cited by examiner

REDUCING INSTANTANEOUS WIND NOISE

TECHNICAL FIELD

The present invention relates to the digital processing of signals from microphones or other such transducers, and in particular relates to a device and method for performing wind noise reduction in such signals by reducing spikes or instantaneous occurrences of wind noise.

BACKGROUND OF THE INVENTION

Processing signals from microphones in consumer electronic devices such as smartphones, hearing aids, headsets and the like presents a range of design problems. There are usually multiple microphones to consider, including one or more microphones on the body of the device and one or more external microphones such as headset or hands-free car kit microphones. In smartphones these microphones can be used not only to capture speech for phone calls, but also for recording voice notes. In the case of devices with a camera, one or more microphones may be used to enable recording of an audio track to accompany video captured by the camera. Increasingly, more than one microphone is being provided on the body of the device, for example to improve noise cancellation as is addressed in GB2484722 (Wolfson Microelectronics).

The device hardware associated with the microphones should provide for sufficient microphone inputs, preferably with individually adjustable gains, and flexible internal routing to cover all usage scenarios, which can be numerous in the case of a smartphone with an applications processor. Telephony functions should include a "side tone" so that the user can hear their own voice, and acoustic echo cancellation. Jack insertion detection should be provided to enable seamless switching between internal to external microphones when a headset or external microphone is plugged in or disconnected.

Wind noise detection and reduction is a difficult problem in such devices. Wind noise is defined herein as a microphone signal generated from turbulence in an air stream flowing past microphone ports, as opposed to the sound of wind blowing past other objects such as the sound of rustling leaves as wind blows past a tree in the far field. Wind noise can be objectionable to the user and/or can mask other signals of interest. It is desirable that digital signal processing devices are configured to take steps to ameliorate the deleterious effects of wind noise upon signal quality.

Any discussion of documents, acts, materials, devices, articles or the like which has been included in the present specification is solely for the purpose of providing a context for the present invention. It is not to be taken as an admission that any or all of these matters form part of the prior art base or were common general knowledge in the field relevant to the present invention as it existed before the priority date of each claim of this application.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

In this specification, a statement that an element may be "at least one of" a list of options is to be understood that the element may be any one of the listed options, or may be any combination of two or more of the listed options.

SUMMARY OF THE INVENTION

According to a first aspect the present invention provides a method of wind noise reduction, the method comprising:

obtaining a first signal from a first microphone and a contemporaneous second signal from a second microphone;

comparing a level of the first signal to a level of the second signal, within a short time frame; and if the level of the first signal exceeds the level of the second signal by greater than a predefined difference threshold, applying a suppression to the first signal.

According to a second aspect the present invention provides a device for wind noise reduction, the device comprising:

first and second microphones; and a processor configured to obtain a first signal from the first microphone and a contemporaneous second signal from the second microphone, the processor further configured to compare a level of the first signal to a level of the second signal, within a short time frame, and if the level of the first signal exceeds the level of the second signal by greater than a predefined difference threshold, the processor further configured to apply a suppression to the first signal.

The signal level may in some embodiments be determined within a short time frame by determining the substantially instantaneous signal level, in the sense that the signal level may be determined over a small number of signal samples, within a small time window such as 50 ms, or using a leaky integrator having a short time constant. In each such embodiment it is desirable that short term effects such as wind noise spikes can be identified rapidly in the determined signal level.

The signal level may in some embodiments comprise a signal magnitude, signal power, signal energy or other suitable measure of signal level reflecting wind noise spikes.

The predefined difference threshold is in some embodiments set to a value which exceeds expected signal level differences between microphones, such as may arise from occlusion when a signal source is to one side of the device, while being less than a signal level difference which arises in the presence of significant wind noise spikes.

In some embodiments the first and second microphones are matched for an acoustic signal of interest before the wind noise reduction is applied. For example the microphones may be matched for speech signals.

In some embodiments, a suppression applied to the first signal may be smoothed to avoid artefacts. In such embodiments the first signal is preferably delayed by a time corresponding to the smoothing time, to allow the suppression sufficient time to reach the desired level simultaneously with the onset of a wind noise spike.

The desired degree of suppression may in some embodiments be calculated as being the difference between the first signal level and the second signal level, less the predefined difference threshold. Alternatively, the desired degree of suppression may be greater than or less than such a value. Calculation of a gain to be applied in order to achieve the desired degree of suppression may in some embodiments include a high pass filter in order that steady state level differences between the microphones do not give rise to suppression.

In some embodiments, a third (or additional) microphone signal may be obtained, and a suppression may be applied to the first signal if either the second or third (or additional)

signal level falls below the first signal level by more than the predefined signal level difference. Such embodiments may be advantageous in improving wind noise suppression on occasions when one of the second and third signals is corrupted by wind noise simultaneously with the first signal.

In some embodiments, the method of the present invention may be applied in respect of one or more subbands of the first and second (and any additional) signals.

The wind noise reduction technique of the above embodiments may in some embodiments be selectively disabled when it is determined that little or no wind noise is present. Wind noise detection for this purpose may be effected by any suitable technique, and for example may be performed in accordance with the teachings of International Patent Application No. PCT/AU2012/001596 by the present applicant, the content of which is incorporated herein by reference. In some embodiments, wind noise reduction is gradually disabled, or gradually enabled, to avoid artefacts which may result from a step-change in wind noise reduction processing.

According to another aspect the present invention provides a computer program product comprising computer program code means to make a computer execute a procedure for wind noise reduction, the computer program product comprising computer program code means for carrying out the method of the first aspect.

BRIEF DESCRIPTION OF THE DRAWINGS

An example of the invention will now be described with reference to the accompanying drawings, in which.

DESCRIPTION OF THE PREFERRED EMBODIMENTS

Figure 1:
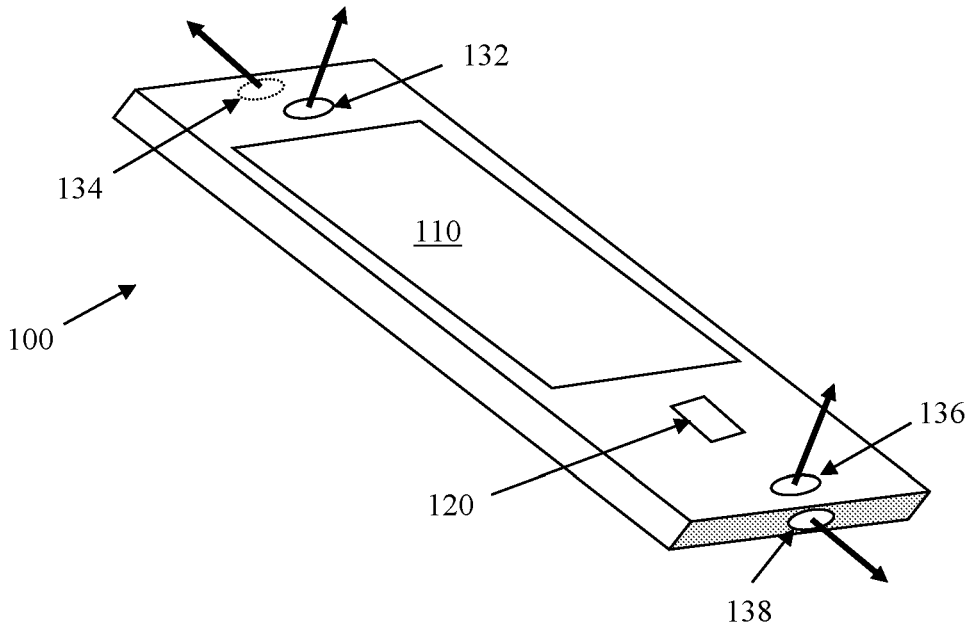
FIG. 1 illustrates the layout of microphones of a handheld device in accordance with one embodiment of the invention.

FIG. 1 illustrates a handheld smartphone device 100 with touchscreen 110, button 120 and microphones 132, 134, 136, 138. The following embodiments describe the capture of audio using such a device, for example to accompany a video recorded by a camera (not shown) of the device or for use as a captured speech signal during a telephone call. Microphone 132 captures a first microphone signal, and microphone 134 captures a second microphone signal. Microphone 132 is mounted in a port on a front face of the device 100, while microphone 134 is mounted in a port on an end face of the device 100. Thus, the port configuration will give microphones 132 and 134 differing susceptibility to wind noise, based on the small scale device topography around each port and the resulting different effects in airflow past each respective port. Consequently, the signal captured by microphone 132 will suffer from wind noise in a different manner to the signal captured by microphone 134.

Figure 2:
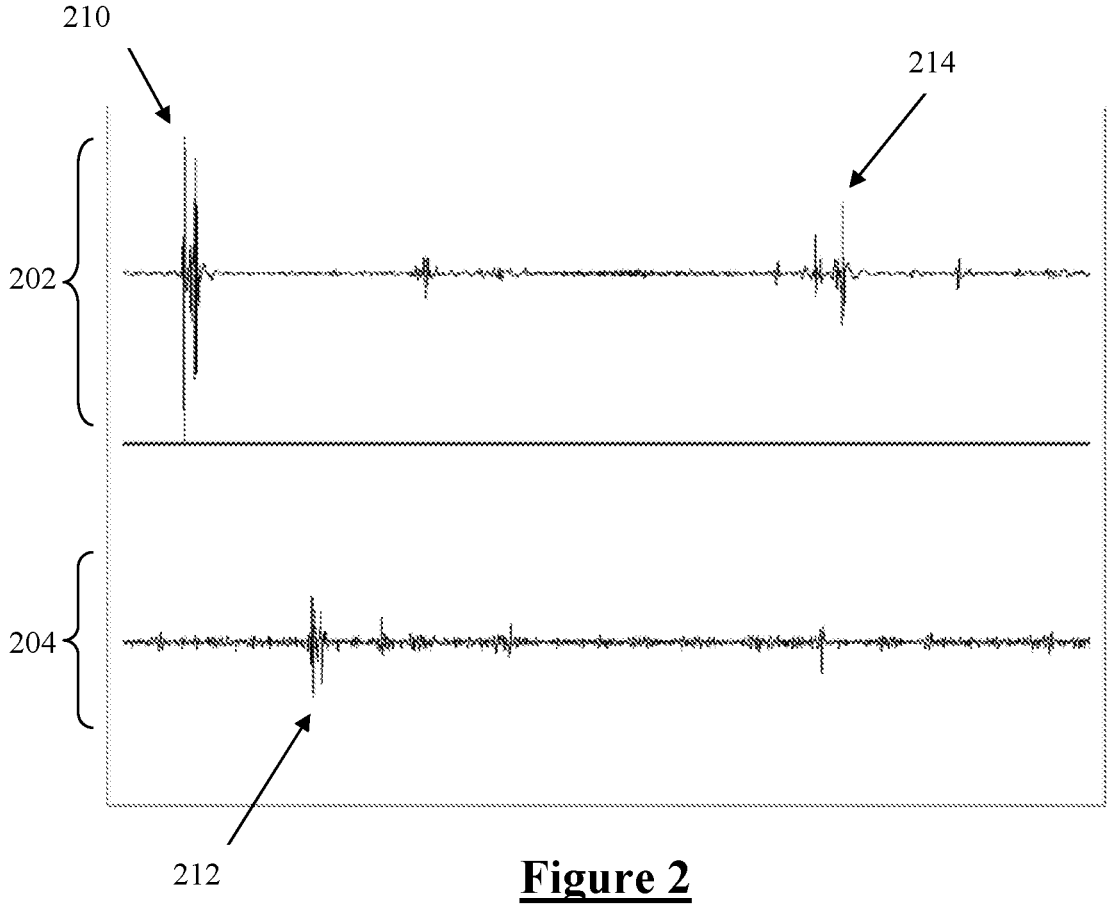
FIG. 2 is a time domain representation of a stereo recording obtained from two microphones.

FIG. 2 illustrates a stereo recording of microphone signals 202 and 204 obtained from two such microphones, with the presence of wind noise spikes 210, 212, 214. As can be seen, in turbulent wind conditions the wind noise changes its level in a very short amount of time (typically within 50 ms). In the time domain graph of FIG. 2, the wind noise presents as a spike in the signal. This type of wind spike is difficult to remove by suppression or mixing, because the spike has a very swift onset and a very short duration. Typical wind noise suppression or mixing generally cannot adapt sufficiently swiftly to adequately suppress such spikes.

The present invention recognises that the wind noise is local to each microphone port, and that as a consequence the wind noise present in each signal is uncorrelated between microphones. That is, wind noise spikes 210, 212, 214 tend not to happen simultaneously on all microphones. The present invention thus provides for an assessment of the instantaneous level differences between the signals from each respective microphone. When a large instantaneous level difference exists, or when a large level difference exists for a short period such as 50 ms, this is indicative of a wind noise spike on one channel. In contrast, in non-windy conditions the instantaneous or short term level differences occurring in the presence of normal acoustic signals are generally very small, as these signals are correlated between each microphone. The level differences between microphones do however depend on whether the microphones have been matched for the target signal, for example depending on whether the microphones have been matched for speech.

The present embodiment of the invention thus provides for the following process for suppression of instantaneous wind noise spikes. The microphone signals are matched for a certain type of acoustic signal, for example speech. A primary input signal is obtained, comprising either a signal from a microphone or the output of a preceding processing stage. The primary input signal is buffered, and the dB power of the primary signal is calculated as $P_0$.

Figure 3:
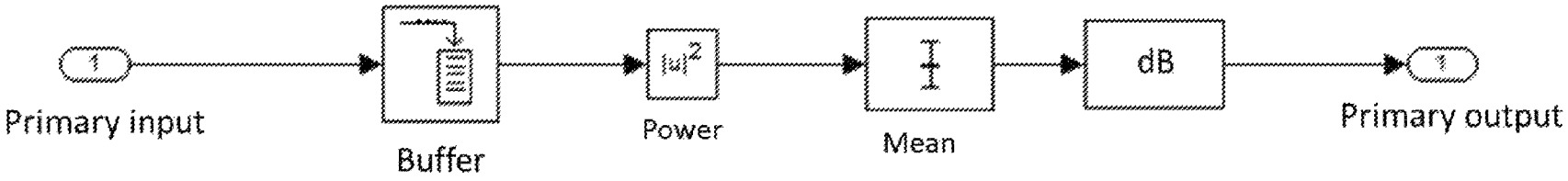
FIG. 3 is a schematic of a system for calculating dB power of a signal.

Each microphone signal is buffered and the signal power in dB is calculated as $P_j$, where j=1 . . . N, and N is the number of microphones in the system. FIG. 3 illustrates the primary input signal being buffered, the signal power being averaged and the dB Power being calculated. The power $P_{min}$ of the signal having least power is then determined at 412, $P_{min}=\min(P_1, P_2, \ldots P_N)$.

The present embodiment allows for a certain degree of signal level difference between the microphones. This is because depending on the direction of arrival of the target signal of interest, it can be appropriate that a level difference may exist between the mic inputs. For example, where a person is speaking to one side of the device 100, one microphone may be relatively more occluded than the other, giving rise to signal level differences even in the absence of wind noise, and even when the microphones are matched. Accordingly, the present embodiment provides at 434 a parameter D which is the allowed level difference in the system.

A suppression G is then calculated, for the purpose of suppressing signals suffering from wind noise. The suppression G, in dB, is determined as being:

$$G=\max(0,(P_0-P_{min}-D))*\text{ratio}$$

where ratio can be any negative number, and is applied at 462.

If ratio is between −1 and 0, under suppression will be applied, in that the wind noise spike will be partly suppressed to a level greater than $P_{min}$+D. If ratio takes a value less than −1, over-suppression will be applied, in that the wind noise spike will be suppressed to a level less than $P_{min}$+D.

Figure 4:
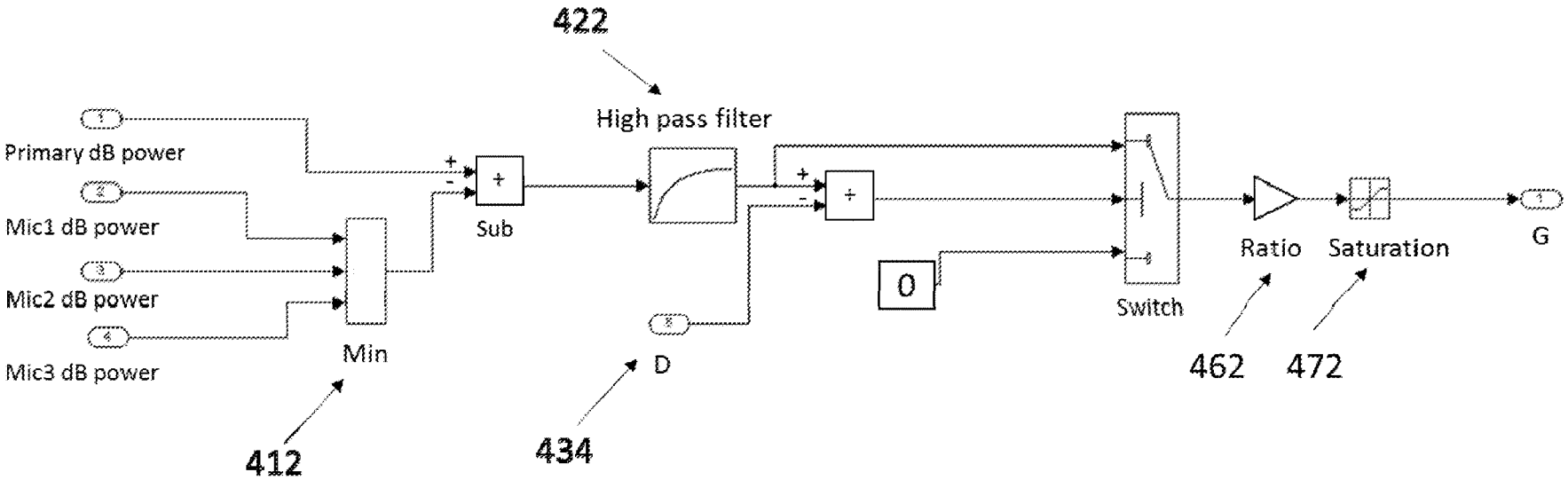
FIG. 4 is a schematic of a system for determining a suppression gain to apply to a primary signal to suppress instantaneous wind noise.

In the embodiment shown in FIG. 4, the suppression G, in dB, is determined as $$G=\max(0,\mathrm{HPF}(P_0-P_{min})-D)*\mathrm{ratio}$$

where HPF( ) is a high pass function applied at 422 so that the dB suppression gain will be zero for the long term level difference, for example if the microphones mismatch.

Figure 5:
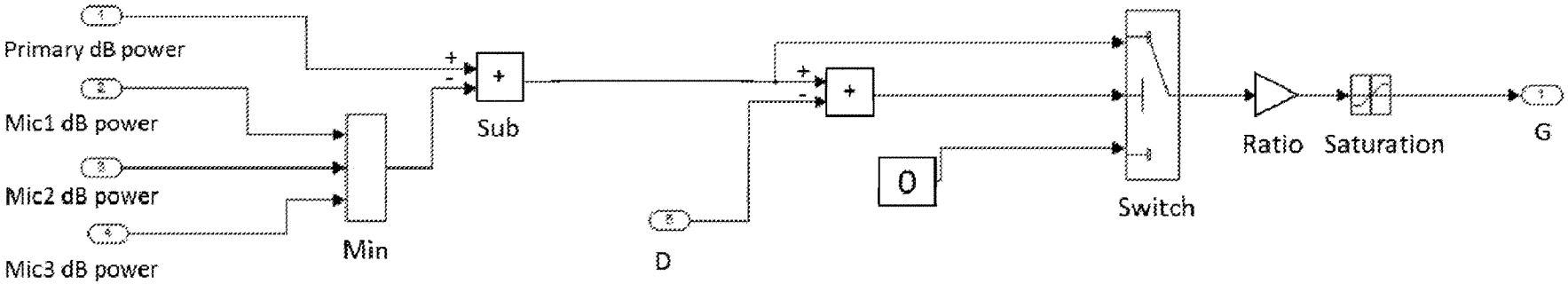
FIG. 5 is a schematic of another system for determining a suppression gain to apply to a primary signal to suppress instantaneous wind noise.

However as shown in FIG. 5 alternative embodiments may omit any HPF function.

Next, at 472 G is saturated between min gain which is a negative number, for example −30 dB, and 0. The linear gain is then calculated as $g=10^{(G/20)}$. The primary input signal is multiplied by g as the output.

Figure 6:
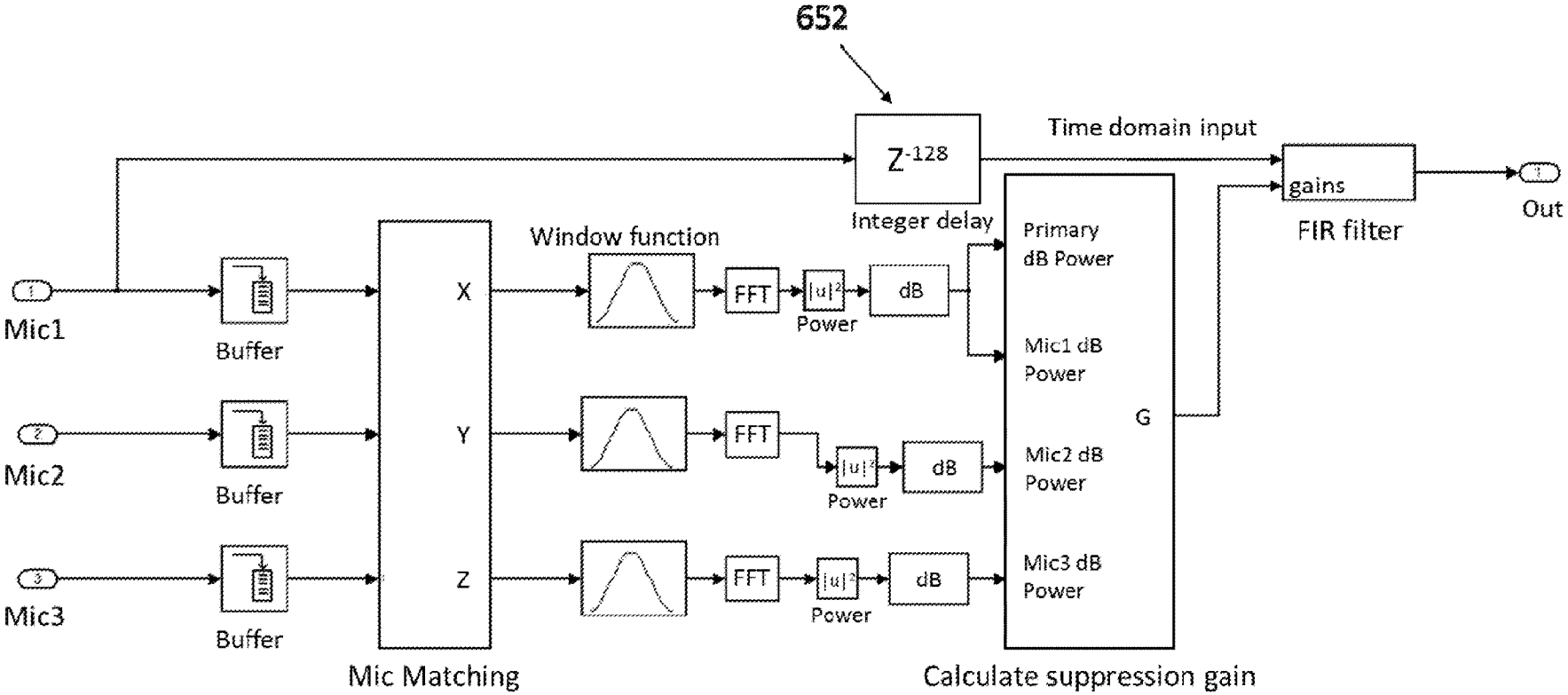
FIG. 6 is a system level circuit illustrating the delay applied to the primary signal.
Figure 7:
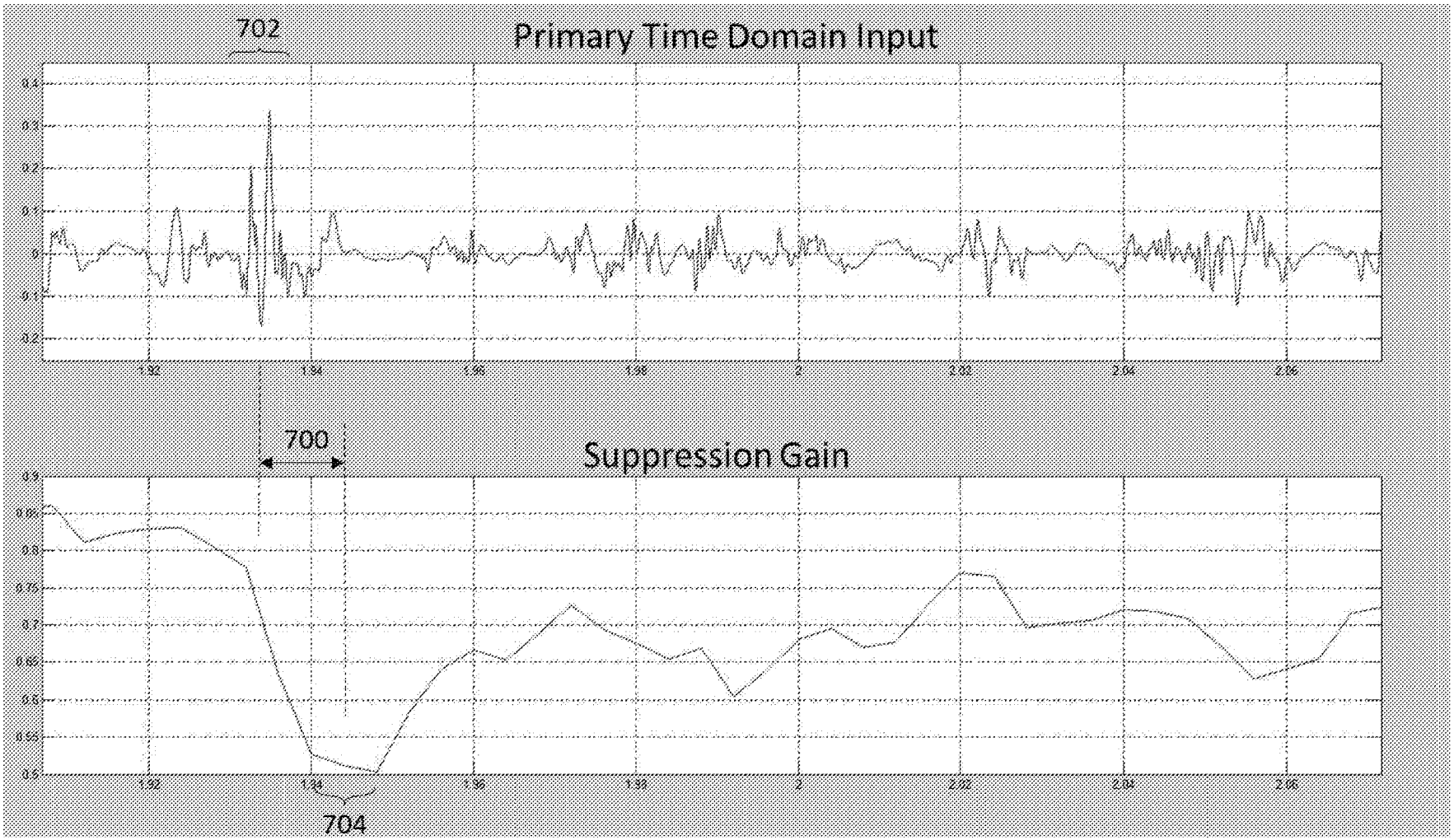
FIG. 7 is a time domain plot of the un-delayed primary signal, at top, and the smoothed suppression gain, at bottom.

In this embodiment, the gain g is smoothed over time to avoid audible artefacts which might otherwise result from overly swift changes in gain. The gain thus takes a small amount of time ($t_{smooth}$) to reach the desired value g. To ensure that the smoothed gain has reached the desired value g simultaneously with the occurrence of the wind spike, the primary input is delayed by $t_{smooth}$ before being suppressed to produce the wind-noise-suppressed output. FIG. 6 is a system level circuit illustrating the delay applied at 652 to the primary signal so that the suppression gain desirably coincides with wind noise spikes. FIG. 7 illustrates the need for the delay element 652. The upper plot in FIG. 7 is the time domain primary input without delay. The lower plot is the suppression gain. From the plot we can see that a 100 ms delay 700 is required in order to align the wind noise spike 702 in the primary input with the negative maxima or gain trough 704.

In another embodiment, the above algorithm is applied on a subband by subband basis, rather than on a fullband basis. This might involve determining G by assessing only one or a small number of subbands, and then applying the determined G only in that subband or in a great number of subbands or even across the fullband of the primary signal. Alternatively, a unique $G_i$ might be determined for the or each subband assessed, and applied only within that subband.

Figure 8:
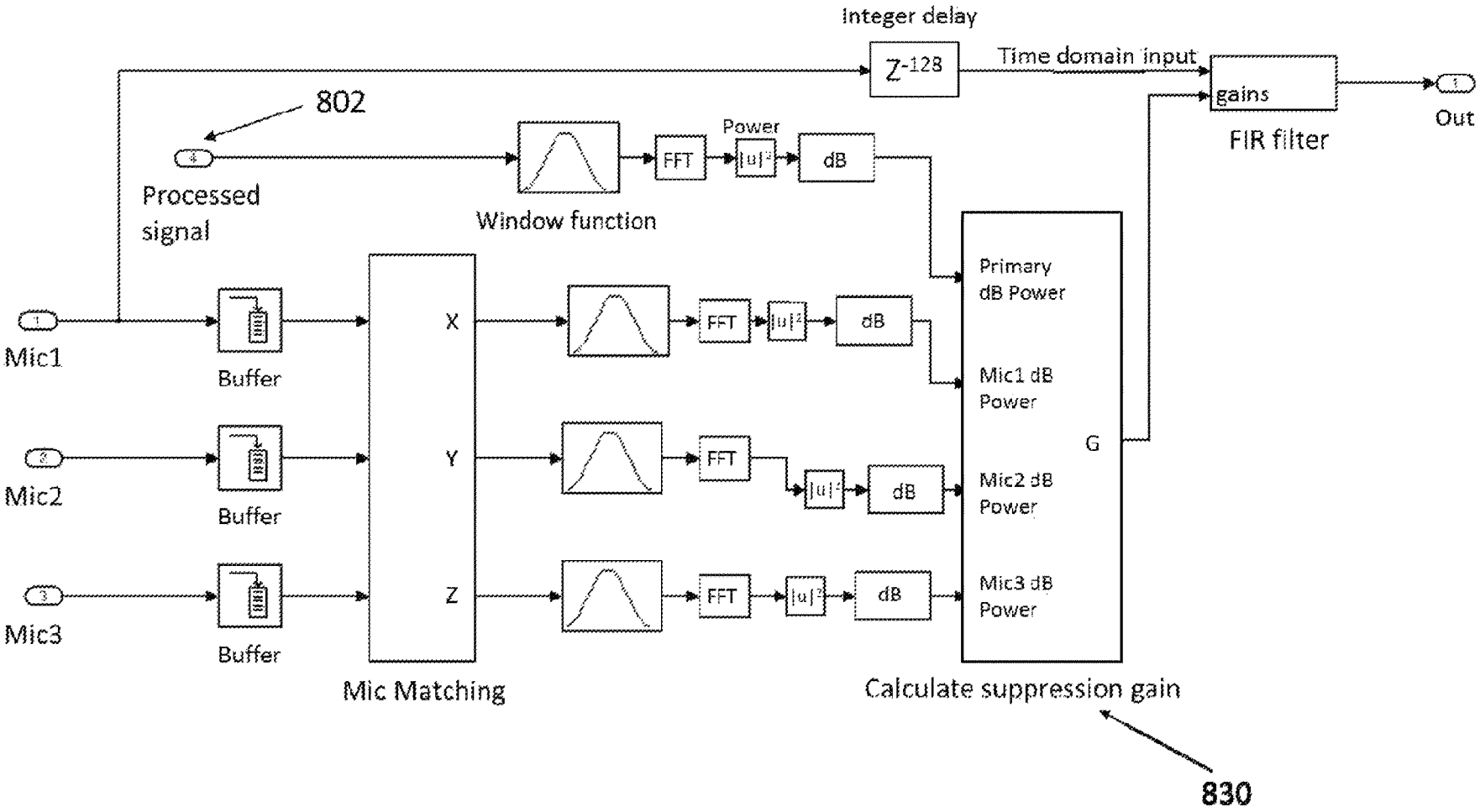
FIG. 8 is a system schematic of another embodiment in which the primary input operated upon by the gain suppression calculation module is preprocessed.

FIG. 8 illustrates another embodiment in which the primary input to the suppression gain calculation module 830 is a preprocessed signal 802 which in this embodiment is produced by mixing all of the microphone signals.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not limiting or restrictive.

The invention claimed is:

1. A method of reducing wind noise in a first audio signal, the method comprising:

receiving the first audio signal;

receiving a plurality of second audio signals other than the first audio signal from a plurality of microphones;

determining a signal level of each of the first audio signal and the plurality of second audio signals;

comparing the signal level of the first audio signal to a signal level of a second audio signal having the lowest signal level of the plurality of second audio signals, within a first time frame; and if the signal level of the first audio signal exceeds the signal level of the second audio signal having the lowest signal level by greater than a predefined difference threshold, applying a suppression to the first audio signal to provide a modified first audio signal having reduced wind noise.

2. The method of claim 1 wherein each signal level is determined by determining the substantially instantaneous signal level.

3. The method of claim 2 wherein the substantially instantaneous signal level is determined over a small number of signal samples, within the first time frame.

4. The method of claim 1 wherein the first time frame is 50 ms or less.

5. The method of claim 2 wherein the substantially instantaneous signal level is determined using a leaky integrator.

6. The method of claim 1 wherein each signal level comprises a signal magnitude.

7. The method of claim 1 wherein the predefined difference threshold is set to a value which exceeds expected signal level differences between the plurality of microphones while being less than a signal level difference which arises in the presence of significant wind noise spikes.

8. The method of claim 1 further comprising matching the plurality of microphones for an acoustic signal of interest before the wind noise reduction is applied.

9. The method of claim 8 wherein the plurality of microphones are matched for speech signals.

10. The method of claim 1 wherein a suppression applied to the first audio signal is smoothed to avoid artefacts.

11. The method of claim 10 wherein the first audio signal is delayed by a time corresponding to the smoothing time, to allow the suppression sufficient time to reach the desired level simultaneously with the onset of a wind noise spike.

12. The method of claim 1 wherein the suppression is calculated as:

$$(|S_1-S_2|)-D_T,$$

where $S_1$ is the first audio signal level, $S_2$ is the second audio signal level, and $D_T$ is the predefined difference threshold.

13. The method of claim 1 wherein calculation of a gain required to achieve the suppression includes a high pass filter so that steady state level differences between the plurality of microphones do not give rise to suppression.

14. The method of claim 1 wherein the one or more second audio signals comprises the first audio signal.

15. The method of claim 1, wherein suppression is applied only in respect of one or more subbands of the first audio signal.

16. The method of claim 1, further comprising selectively disabling the wind noise reduction when it is determined that little or no wind noise is present.

17. A device for reducing wind noise in a first audio signal, the device comprising:

a plurality of microphones; and a processor configured to:

receive a first audio signal;

receive a plurality of second audio signals other than the first audio signal from a plurality of microphones, wherein the first audio signal is not received from the plurality of microphones;

determine a signal level of each of the first audio signal and the plurality of second audio signals;

compare the signal level of the first audio signal to a signal level of the second audio signal having the lowest signal level of the plurality of second audio signals, within a first time frame; and if the signal level of the first audio signal exceeds the signal level of the second audio signal having the lowest signal level by greater than a predefined difference threshold, apply a suppression to the first audio signal to provide a modified first audio signal having reduced wind noise.

18. The device of claim 17 wherein the first time frame is 50 ms or less.

19. The device of claim 17, wherein the processor is further configured to apply the suppression over a smoothing time in order to avoid artefacts, the device further comprising a delay element configured to delay the first audio signal by a time corresponding to the smoothing time to allow the suppression sufficient time to reach the desired level simultaneously with the onset of a wind noise spike.

20. The device of claim 17, wherein the processor is further configured to apply a high pass filter to calculations of a gain required to achieve the suppression, so that steady state level differences between the microphones do not give rise to suppression.

* * * * *